United States Patent [19]

Parkinson et al.

[11] 4,330,380

[45] May 18, 1982

[54] ELECTRODEPOSITION OF SULFUR-BEARING NICKEL

[75] Inventors: Ronald Parkinson; Robert W. Howard, both of Thornhill, Canada

[73] Assignee: Falconbridge Nickel Mines Limited, Thornhill, Canada

[21] Appl. No.: 206,469

[22] Filed: Nov. 13, 1980

[30] Foreign Application Priority Data

Nov. 21, 1979 [GB] United Kingdom ..... 7940202

[51] Int. Cl.[3] ..... C25C 1/08; C25D 3/12

[52] U.S. Cl. ..... 204/123; 204/43 T; 204/49; 204/112; 204/113; 204/263; 204/266

[58] Field of Search ..... 204/123, 112, 49, 43 T, 204/263, 266, 113

[56] References Cited

U.S. PATENT DOCUMENTS 4,082,641 4/1978 Parkinson et al. ..... 204/281

4,087,339 5/1978 Elliot et al. ..... 204/112

4,155,821 5/1979 Grontoft ..... 204/113

*Primary Examiner*—G. L. Kaplan

*Attorney, Agent, or Firm*—Ridout & Maybee

[57] ABSTRACT

When the electrodeposition of nickel is carried out in the presence of sulphur, it is desirable to control the content and the distribution of the sulphur in the deposited nickel. Sulphur-bearing nickel is deposited onto a multiplicity of cathodes (12) in an electrolytic cell. The electrolyte contains nickel ions, chloride ions, and at least one thiocyanate compound. To prevent oxidation of the thiocyanate ions by the chlorine gas generated at the anode (11), the chlorine is almost completely excluded from the cathode compartment by providing a flow of electrolyte from the cathode (12) to the anode (11) and by continuously removing chlorine and chlorine-containing electrolyte from the anode through a manifold (26). A weir (14) prevents back flow.

4 Claims, 3 Drawing Figures

ELECTRODEPOSITION OF SULFUR-BEARING NICKEL

This invention relates to the electrodeposition of sulfur-bearing nickel and more particularly relates to the electrodeposition of sulfur-bearing nickel from a solution of nickel salts.

The commercial utilization of nickel includes electrodeposition on the surface of a substrate. This is a well-known method of corrosion protection. In other applications the deposited nickel layer serves as a further substrate for another metal such as, for example, chromium, to be deposited. It is common practice to obtain the nickel in a form suitable for the above electrodeposition or electroforming, by means of anodic dissolution in an electrolytic cell. In the process of anodic dissolution, however, the high purity nickel will in some instances, exhibit passivation such as by the formation of a nickel oxide film, which leads to uneven dissolution. Regardless of the purpose for which the nickel solution has been obtained, it is desirable that the anodic dissolution be uniform.

It has been shown that the presence of small amounts of sulphur dissolved or dispersed in the nickel will allow dissolution at a lower, stable anode potential and lead to more uniform anodic corrosion. U.S. Pat. No. 4,087,339 describes a method wherein sulphur-containing nickel is electrowon from a nickel-containing solution in the presence of specific sulphur-bearing compounds such as, for example, thiosulphates, bisulphites, thiourea, and tetrathionates. These compounds are very sensitive to oxidation by chlorine, and the process therein describes an electrolytic cell arrangement in which both the anodes and the cathodes are separated by their respective diaphragms, to prevent chlorine generated at the anode entering the electrolyte in the vicinity of the cathode, and subsequently oxidizing the sulphur-bearing additives. The electrolyte over-flow in this prior art process, is placed outside the cathode compartment, drawing spent electrolyte from both the cathode and the anode compartments. Air purges the gas space above the anolyte level, removing the chlorine gas generated. The chlorine dissolved in the anolyte, on the other hand, enters the electrolyte column between the two compartments and is removed at the overflow, but a sizeable portion of the dissolved chlorine, by virtue of its high solubility, will diffuse back into the cathode compartment and oxidize the sulphur-bearing additives used in that process. The electrolyte solutions usually contain sulphate ions as well. There are, however, unaffected by chlorine as they represent the highest oxidation state of sulphur; nor can they be regarded as bearing depositable sulphur at the cathode potentials applied in nickel electrodeposition.

The presence of a depolarizing agent such as sulphur will enhance the even, anodic dissolution of nickel, but at the expense of the complete dissolution of the metal. Thus excessive amounts of sulphur dispersed in the nickel will result in the formation of a black residue in the anode baskets or in the bottom of the cell wherein the sulphur-containing nickel is used, consequently the careful control of sulphur at the desired level has great importance in commercial use. It has now been found that thiocyanates, when used as sulphur-bearing compounds added to a nickel-containing solution, are less sensitive to the effects of traces of chlorine present than the compounds listed by the prior art, and hence a greater degree of control in the sulphur content of the electrodeposited nickel can be achieved. Advantageously this also leads to a smaller degree of scatter in the level of sulphur codeposited, resulting in less residue formation when the product is used in anodic dissolution processes discussed hereinabove.

The presence of thiocyanate in plating solutions has been described and applied in the prior art, but with objects and means different from those of the present application. U.S. Pat. No. 2,844,530 teaches a process for obtaining a strongly coloured, decorative, colourfast and abrasion resistant black nickel plate from nickel chloride solutions. The principal additive in the nickel electroplating process is zinc chloride, but the additional presence of ammonium chloride and sodium thiocyanate is also taught.

British Pat. No. 1,414,353 and French Pat. No. 2,202,953 describe an apparatus, method and solution for electroplating film-like layers of magnetic nickel-iron alloy. The essence of this process lies in the simultaneous application of a magnetic field and polarized light during the electroplating of the alloy from a solution of nickel and iron salts, boric acid and saccharin. The French patent mentions the additional presence of small amounts of sodium thiocyanate.

Thus the only prior art known to the applicant that teaches the addition of thiocyanate to electrolytes does so in combination with other reagents for the purpose of obtaining black nickel plate or a film of electromagnetic iron-nickel alloy, but does not mention, nor anticipate means for using thiocyanate to introduce controlled amounts of sulphur into electrodeposited nickel.

In summary the present invention consists in a process for electrodepositing sulphur-bearing nickel onto a multiplicity of cathodes in an electrolytic cell from an aqueous electrolyte solution, said cell having weir means and containing anodes each of which is surrounded by a diaphragm forming an anode compartment enclosing anolyte therein, the improvement comprising using an electrolyte containing nickel ions, chloride ions and at least one thiocyanate compound selected from the group consisting of alkali, ammonium and alkaline earth metal thiocyanates and maintaining the electrolyte at different levels within and without the anode compartments, by (i) adding fresh electrolyte outside the anode compartments, (ii) withdrawing electrolyte by the weir means outside the anode compartments below the anolyte levels, and (iii) simultaneously withdrawing anolyte and chlorine gas by suction from the anode compartments, above the electrolyte level of the cell outside the anode compartments.

It is desirable to keep the chlorine back-diffusion to the catholyte to a minimum, which may be further diminished by enclosing the cathode as well by a diaphragm, thereby rendering two separate barrier means in the path of the dissolved chlorine gas. In the preferred embodiment of the present invention the metal is deposited onto a multiplicity of cathodes, each surrounded by a diaphragm forming cathode compartment with catholyte therein, in an electrolytic cell having weir means and anodes which are also surrounded by diaphragms forming anode compartments with anolyte therein, and the process further comprises maintaining the aqueous electrolyte solution containing nickel ions, chloride ions and at least one thiocyanate compound selected from the group consisting of alkali, ammonium, and alkaline earth metal thiocyanates, in the respective compartments of the said cell at different levels by adding fresh electrolyte to the cathode compartments, withdrawing electrolyte by the weir means, which is located outside both the cathode and anode compartments, and also withdrawing electrolyte and chlorine, by suction from the anode compartments above the catholyte levels.

Figure 1:
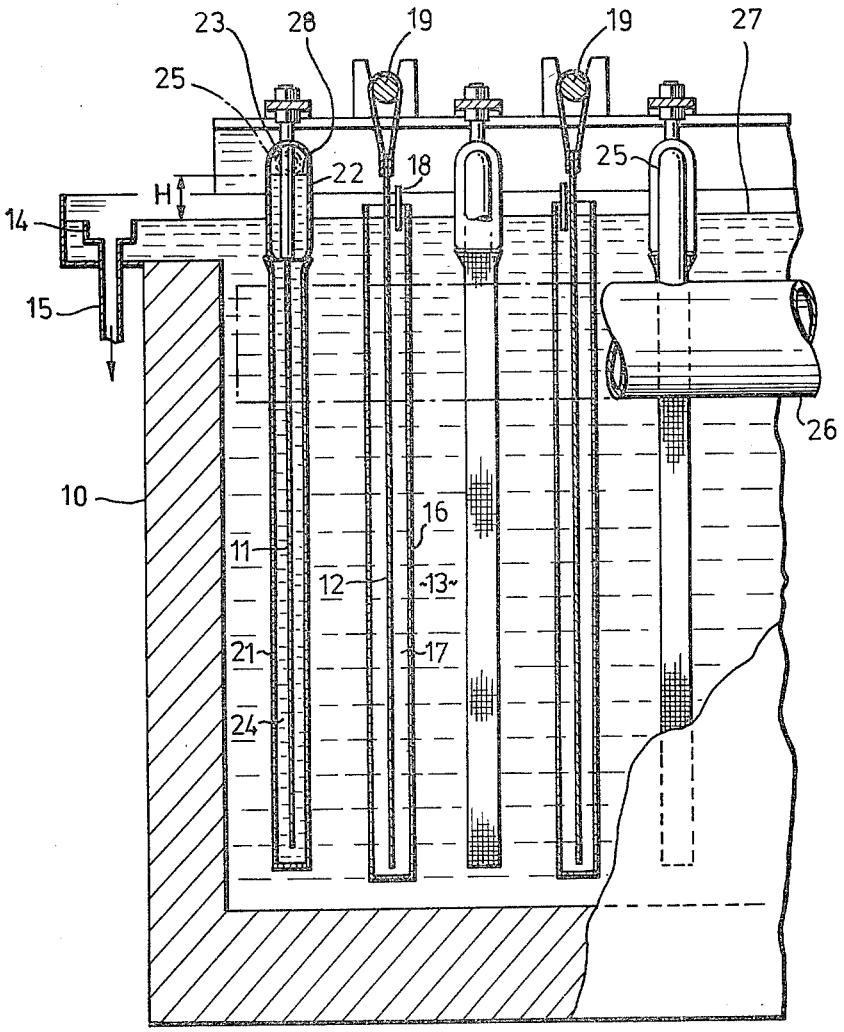
FIG. 1 illustrates the electrodes and diaphragms in the cell for a preferred embodiment of electrodeposition of nickel, described in the present invention.

As already referred to hereinabove, in some nickel electroplating processes involving anodic dissolution, especially in the absence of chloride ions, nickel oxide can form a surface film on the metal which then impedes further entry of nickel ions in solution, and leads to polarization and diminished electrolytic efficiency. Depolarizers, such as sulphur, dissolved or dispersed through the matrix, will reduce the effects of such oxide film by a mechanism which is not clearly understood, and will allow uniform dissolution and the anodic corrosion of the metal to proceed at a lower and steady anodic potential. Sulphur present in excessive quantities, however, will prevent complete dissolution, presumably due to nickel sulphide formation, and give rise to unwarranted sludge in the bottom of the tank, and to residue in the anode baskets. The amount of sludge or residue, and hence the nickel lost for dissolution in the nickel-bearing solution, is more than can be expected from nickel sulphide formation alone, in the sulphur-bearing deposits, as some unbound nickel will be trapped with the insoluble nickel sulphide formed. It is thus important to maintain and control the amount of sulphur dispersed in the nickel, at a level to enhance anodic dissolution thereof while minimizing the amount of undissolved residue. The sulphur as depolarizer, is advantageously codeposited from a solution of nickel ions. For a uniform distribution in the deposit, it is desirable that the said sulphur-bearing compound is evenly distributed in the catholyte. The nickel solution for the purposes of electrodeposition, is usually obtained by acid dissolution or by chloride leaching processes of some nickel-bearing material. In any case, chloride ions will be present in considerable concentration together with nickel ions and sulphate ions in solution. Nickel deposition at the cathodes is accompanied by chlorine generation at the anodes in electrowinning processes. It is well-known, and is shown by elementary chemical reactions, that most of those sulphur atoms in sulphur-bearing compounds which can be deposited at the cathode at the potential range at which nickel is electrowon, are easily oxidized by chlorine molecules. It has been found that thiocyanates are less sensitive to oxidation by chlorine than the sulphur-bearing compounds described by the prior art. The following equations will demonstrate the reaction of chlorine with sulphur-bearing compounds:

$$SO_2+2H_2O+Cl_2\rightarrow SO_4^{--}+4H^++2Cl^-$$
$$2S_2O_3^{--}+Cl_2\rightarrow S_4O_6^{--}+2Cl^-$$
$$CS(NH_2)_2(\text{thiourea})+H_2O+Cl_2\rightarrow CO(NH_2)_2+2H^++2Cl^-+S^\circ(\text{colloidal})$$

It is evident that in the case of these sulphur-bearing compounds, the ratio of depositable sulphur to chlorine molecule in the oxidation reactions, is 1:1. It can be illustrated on the other hand, that the oxidation of a thiocyanate ion will require more chlorine molecules. It is not suggested that the oxidation will only proceed according to the following mechanism, other chemical reactions and products being also possible, but there is considerable evidence to deduce that thiocyanate oxidation requires more than one chlorine molecule, and in case of complete reaction, four molecules are consumed:

$$SCN^-+4Cl_2+6H_2O\rightarrow NH_4^++8Cl^-+8H^+\cdot+CO_2+SO_4^{--}$$

It can thus be expected that the traces of chlorine that diffuse out of the anode compartment are less effective in changing the concentration of depositable sulphur in the catholyte, when the sulphur-bearing compound is thiocyanate. The amount of sulphur in the nickel electrodeposited is proportional to the thiocyanate concentration in the catholyte, and a fraction of a milligram of chlorine which is inevitably present as a result of chlorine generation at the anode, will have substantially no effect on the level of sulphur codeposited.

It is, however, still essential to avoid an excessive buildup of chlorine within the catholyte. To maintain low chlorine levels, in the preferred embodiment of the present invention, an electrowinning cell is utilized, wherein the anode contained in a diaphragm compartment, and a weir extraneous to it, are arranged as described in U.S. Pat. No. 4,155,821, and the cathode is surrounded by a separate diaphragm forming a cathode compartment. The chlorine generated is thereby removed, both as a gas and in the dissolved state, directly from the anode compartment. An added advantage of this arrangement is that the electrolytically obtained chlorine can be easily collected and used in another application. The small amounts of chlorine that may diffuse through the diaphragm forming the anode compartment, will be removed with the electrolyte overflow at the weir. Thus in the path of the dissolved chlorine molecule diffusing to the cathode, there are effectively two diaphragm barriers and two counterflowing streams of spent electrolyte.

FIG. 1 shows the essential parts of such a cell for commercial production of sulphur-bearing nickel deposits. Referring now to FIG. 1, it shows a section of an electrolytic tank, with walls 10 housing a multiplicity of anodes and cathodes. A cathode 12 is suspended from a busbar 19, and it may be a reusable cathode unit as taught in U.S. Pat. No. 4,082,641, or a simple nickel starting sheet. When the reusable cathode unit is used, the deposits obtained are discrete hemispherical or semi-ellipsoidal pieces of metal, each weighing between 5 g to 50 g, having a total surface area which is at least three times that of its flat base and a height to base area ratio in excess of 0.3 in $^{-1}$(0.12 $cm^{-1}$). The type of cathode used depends on the desired shape of the nickel product. In any case, the cathode 12 is surrounded by a diaphragm 16, containing catholyte 17. Fresh electrolyte is fed through an inlet duct 18. The nickel depleted electrolyte 13 leaves the cell via a duct 15, and the level 27 of the catholyte and the spent electrolyte is adjusted by means of a weir 14. An inert metal anode 11 or alternatively a graphite anode, completely enclosed by an anode diaphragm 21 and an anode hood 22, is immersed in anolyte 24. A duct 25 connects anode space 23, with a manifold 26. Suction means (not shown) is applied through the manifold 26, to remove both the chlorine generated and the anolyte over-flow. As a consequence of applied suction and the weir 14, a difference will exist, shown by arrow H, between the level of the catholyte 27 and that of the anolyte 28. It is this suction induced level difference that ensures that the chlorine-containing anolyte is continuously removed via the manifold 26 and that the direction of the flow of the electrolyte is out of the cathode compartment into the anode compartment, hence decreasing chlorine back-diffusion to the minimum. The weir 14 also assists in adjusting the catholyte level to accommodate variations in the porosities of the diaphragms. It can be seen that by the application of the electrowinning cell taught in U.S. Pat. No. 4,155,821 and described in essence hereinabove, only very small amounts of chlorine are likely to enter into the cathode compartment to react with the thiocyanate additive, and hence the sulphur content of the cathodically deposited nickel is advantageously controlled.

An added benefit of the preferred embodiment of the present invention is the virtual elimination of chlorine in the atmosphere surrounding the cells, and thus health hazards are diminished. The process does not rely on air sparging for mixing or chlorine removal, as taught by the prior art, thus loss of electrolyte through mist formation is also avoided.

It has been found that codepositing sulphur from a nickel ion and chloride ion containing solution to achieve a level of sulphur greater than 120 ppm, requires a fairly high concentration such as several mg per liter, of sulphur dioxide, bisulphites or similar sulphur-containing compounds, and without the presence of certain organic levelling agents, the nickel deposits obtained show uneven surface formation and discolouration. Surprisingly the use of thiocyanates as the sulphur-bearing compound added to the nickel solution leads to no such disfigurations even at sulphur levels in excess of 200 ppm in the nickel deposits, and in the absence of levelling agents.

The ease by which sulphur is codeposited with nickel from solutions containing thiocyanates, in addition to the diminished sensitivity of thiocyanate ions to molecular chlorine, demonstrates the advantages of the process described hereinabove. Further advantages of the present invention are illustrated by the following examples.

EXAMPLE 1

Sulphur-bearing nickel was electrodeposited from a solution onto a reusable cathode unit, having a total of 216 conducting islands embedded in a non-conductive plastic material. The anode was a metal sheet unaffected by the electrolyte, forming an anode assembly as shown in FIG. 1. The electrolyte tank held 53 liters of electrolyte, which contained in solution 64.3 g/L nickel, 38.3 g/L sulphate, 71.7 g/L chloride and 14.0 g/L boric acid. The pH of the electrolyte was adjusted to 1.5, and the catholyte temperature was controlled at 61°–63° C. Potassium thiocyanate solution was added to the electrolyte at a rate indicated in Table 1. The electrolytic deposition proceeded for fourteen days. The nickel deposits obtained, each weighing between 32–37 g, were analyzed for sulphur, and their sulphur contents are shown in Table 1:

TABLE 1

| KSCN in Soln. Feed Rate mg/hr | Depositable Sulphur Feed Rate in mg/Ampere hr. | Cathode Current Efficiency % | Average Sulphur in Ni ppm | Range of Sulphur in Ni ppm |
|---|---|---|---|---|
| 5 | 0.067 | 97.7 | 46 | 21–71 (29–62) |
| 10 | 0.133 | 97.8 | 82 | 50–111 (69–96) |
| 15 | 0.200 | 97.9 | 98 | 70–138 (81–118) |
| 20 | 0.266 | 98.1 | 116 | 90–165 (100–132) |

The range of sulphur codeposited with nickel shows the lowest and highest values obtained in the deposits. The bracketed figures show the range of sulphur contents, as determined in over 70% of the samples. The sulphur contents of the deposits appeared to be independent of the position they occupied on the mandrel; the range of the sulphur contents in ppm, was also found to be relatively narrow and within expected experimental error. The appearance of the deposits was unblemished and their shape was relatively symmetrical and evenly formed. No damage to the circulating pumps due to corrosion, or to any other part of the equipment, was observed even after 14 days of continuous operation.

EXAMPLE 2

The cell described in Example 1 was used to produce sulphur-bearing nickel deposits using sulphur dioxide instead of thiocyanate. The cell contained 53 liters of electrolyte of nickel, sulphate, chloride and boric acid in concentrations similar to those given in Example 1. Sulphur dioxide was added in the form of sulphurous said from a closed, collapsible container to give an average sulphur level as depositable sulphur in the electrolyte, of 0.9 mg/L.

Figure 2B:
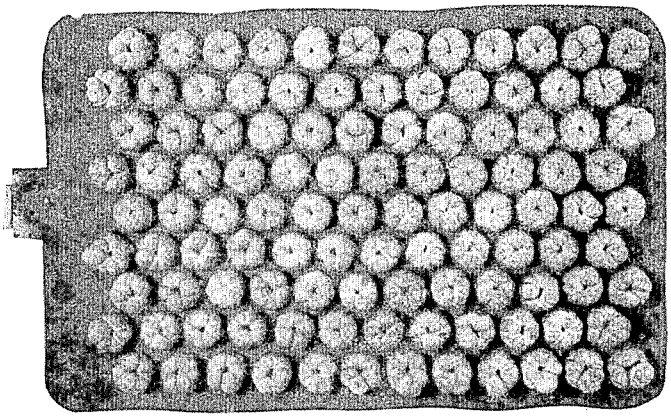
FIG. 2 shows nickel deposits on a cathode obtained with (a) sulphur dioxide addition (b) thiocyanate addition.
Figure 2A:
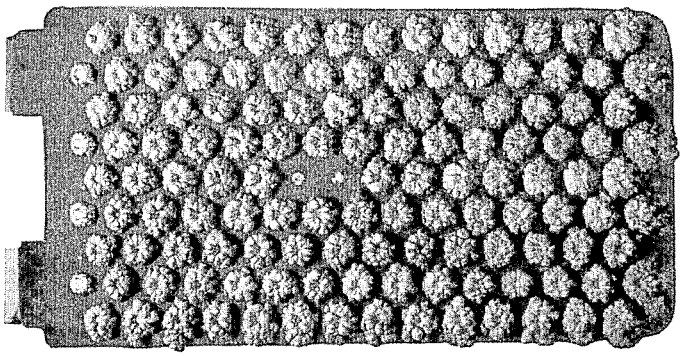

The nickel deposits obtained on the cathode are shown in FIG. 2*a*. The four centre pieces had an average sulphur content of 129 ppm, the sulphur concentration however, varied considerably with the position of the deposit on the cathode, and near the edges the scatter amounted to a range of 72–207 ppm, indicating large variations in the local concentration of the depositable sulphur. In addition, a large portion of the deposits were disfigured, showing wart-like growth, and were also discoloured. There was further difficulty in electrolyte damaging the seals of the recirculating pump after 3 days of operation.

EXAMPLE 3

The electrodeposition was repeated in another experiment using a similar cell as in Example 1 and with potassium thiocyanate as the sulphur-bearing additive. The flow rate of the KSCN solution was adjusted to provide 0.115 mg/L depositable sulphur concentration in the electrolyte. This value was derived by plotting the data in Table 1 to obtain a relationship between the potassium thiocyanate feedrate and the sulphur contents of the nickel deposits; and the graph was then intrapolated for sulphur content that was similar to the sulphur level found in deposits obtained with sulphur dioxide additive to the electrolyte, and which had been situated in about the centre of the cathode. The nickel deposits obtained in the presence of thiocyanate concentration had an average sulphur content of 117, with a scatter of 100–132 ppm. The deposition of nickel from the electrolyte is shown in FIG. 2*b;* the lack of discolouration or disfiguration is clearly demonstrated. There appeared to be no sign of damage to the circulating pump after several weeks of operation, nor was there any loss of sulphur-bearing compound to the surrounding atmosphere, as would occur if pump seals were damaged, or if any of the sulphur-bearing compounds were volatile and would escape from the electrolytic tanks.

The Figures and values of sulphur contents provided in Examples 2 and 3 illustrate that the level and distribution of sulphur in the nickel deposits can be controlled to a higher degree by thiocyanate addition than by sulphur dioxide. Other advantages lie in the more efficient utilization of sulphur in thiocyanate as the sulphur-bearing additive, and in the avoidance of corrosion.

EXAMPLE 4

Sulphur-bearing nickel was electrodeposited in the manner described in Examples 1 and 3 from an electrolyte solution containing:

78 g/L nickel ions
81 g/L chloride ions
58 g/L sulphate ions
16 g/L sodium ions and
3.2 g/L boric acid The pH of the solution was 1.5. Potassium thiocyanate was added to the solution continuously during the electrodeposition lasting several days, giving a feed rate of 0.14 mg depositable sulphur per Ampere hour. The average sulphur content of the deposit determined by analysis, was 139 ppm. The standard deviation, calculated from the sulphur contents measured on six individual deposits taken at random, was ±13 ppm sulphur.

EXAMPLE 5

Sulphur bearing nickel was electrodeposited from a similar electrolyte solution and in the manner described in Example 4. The sulphur bearing additive in the present example was ammonium thiocyanate, added at a similar feed rate, that is to provide 0.14 mg of depositable sulphur per Ampere hour. The average sulphur content of the deposits obtained was 118 ppm, and the standard deviation, calculated from the analyses of the individual samples, was ±17 ppm sulphur.

EXAMPLE 6

Sulphur bearing nickel was electrodeposited in the manner described in Example 4, and from a similar electrolyte solution. The sulphur bearing additive in the present example was added in the form of a calcium thiocyanate solution to provide a feed rate of 0.14 mg depositable sulphur per Ampere hour. The average sulphur content in the deposits obtained was found to be 185±25 ppm sulphur.

Examples 4, 5 and 6 illustrate that sulphur-bearing nickel deposits with reproducibly controlled sulphur levels, can be electrodeposited from nickel containing electrolytes with thiocyanate ions as the depositable sulphur bearing additives. There is a small variation in the level of sulphur deposited, depending on the nature of the cations also present, this effect however is reproducible and suitable concentration adjustments can easily be made.

EXAMPLE 7

The effect of very small amounts of chlorine on the sulphur codeposited with nickel is considered in this example. The sulphur contents of the deposits obtained were determined analytically on several samples, that had been electrodeposited from solution with thiocyanate as the codepositable sulphur-bearing additives, or with thiosulphate additive, which is a reagent taught in the prior art for obtaining sulphur-containing nickel. The electrodepositions were repeated with similar amounts of chlorine diffusing into the electrolyte solutions. The results are compared in Table 2:

TABLE 2

| Sulphur-Bearing Additive | Dissolved Chlorine bled into Electrolyte | Sulphur Content of Ni Deposits | Standard Deviations of Sulphur Content | |
|---|---|---|---|---|
| $SCN^-$ | no | 52 ppm | ±21 ppm | ±40% |
| $SCN^-$ | yes | 46 | ±23 | ±50 |
| $S_2O_3^{=}$ | no | 33 | ±13 | ±39 |
| $S_2O_3^{=}$ | yes | 22 | ±21 | ±95 |

The experiments clearly show that under the same conditions of electrodepositing sulphur-bearing nickel, the reduction in the amount of sulphur codeposited, is less in the case of thiocyanate than when thiosulphate is the sulphur-bearing additive. The scatter in the sulphur contents of the deposits is increased, as expected, due to the presence of chlorine, however the scatter is much greater in terms of percentage, that is nearly 100 percent when thiosulphate is the sulphur depositing additive, and only about 50% in the presence of thiocyanate.

We claim:

1. In a process for electrodepositing sulphur-bearing nickel onto a multiplicity of cathodes in an electrolytic cell from an aqueous electrolyte solution, said cell having weir means and containing anodes each of which is surrounded by a diaphragm forming an anode compartment enclosing anolyte therein, the improvement comprising using an electrolyte containing nickel ions, chloride ions and at least one thiocyanate compound selected from the group consisting of alkali, ammonium and alkaline earth metal thiocyanate and maintaining the electrolyte at different levels within and without the anode compartments, by (i) adding fresh electrolyte outside the anode compartments,
(ii) withdrawing electrolyte by the weir means, outside the anode compartments below the anolyte levels, and,
(iii) simultaneously withdrawing anolyte and chlorine gas by suction from the anode compartments above the electrolyte level of the cell outside the anode compartments.

2. A process according to claim 1 wherein each cathode of the said electrolytic cell is also surrounded by a diaphragm forming a cathode compartment enclosing catholyte therein, the fresh electrolyte is added to the cathode compartments, the weir means is located outside both the cathode and anode compartments, and, electrolyte and chlorine gas are withdrawn by suction from the anode compartments, above the electrolyte level.

3. A process according to claim 1 or 2 wherein the electrolyte also contains sulphate ions.

4. A process according to claim 1 or 2 wherein discrete metal deposits are electrodeposited onto the multiplicity of cathodes.

* * * * *